United States Patent [19]

Novak

[11] Patent Number: 4,838,293

[45] Date of Patent: Jun. 13, 1989

[54] TEPEE TENT

[76] Inventor: Terry Novak, P.O. Box 1147, Melrose Park, Ill. 60160

[21] Appl. No.: 175,857

[22] Filed: Mar. 31, 1988

[51] Int. Cl.[4] ..... A45F 1/16

[52] U.S. Cl. ..... 135/100; 135/105; 135/116

[58] Field of Search ..... 135/100, 116, 99, 101

[56] References Cited

U.S. PATENT DOCUMENTS

| | | | |
|---|---|---|---|
| 1,270,701 | 6/1918 | Correll | 135/100 |
| 1,576,942 | 3/1926 | Beebe | 135/100 |
| 2,044,351 | 6/1936 | Eriksson | 135/100 |
| 2,663,306 | 12/1953 | Davis | 135/100 |
| 2,879,780 | 3/1959 | Arbore | 135/100 |
| 2,931,373 | 4/1960 | Larson | 135/116 |
| 3,042,052 | 7/1962 | DesRosier | 135/100 |
| 4,265,261 | 5/1981 | Barker | 135/100 |

*Primary Examiner*—Henry E. Raduazo

*Attorney, Agent, or Firm*—Balogh, Osann, Kramer, Dvorak, Genova & Traub

[57] ABSTRACT

A tepee tent using a combination of rigid and non-rigid tent poles to define a frame structure for supporting a truncated inner cover, the base of the tepee tent being defined by the shaped floor panel secured to ground by pegs, and an outer cover encompassing the frame structure and providing a spacing between the inner cover and the outer cover to improve ventilation therebetween. The outer cover is secured to the rigid tent poles by fasteners. The upper extremities of the rigid and non-rigid tent poles are commonly supported by an apex cup having sockets for securing the rigid tent poles and having hooks for supporting the non-rigid tent poles.

18 Claims, 2 Drawing Sheets

FIG. 1
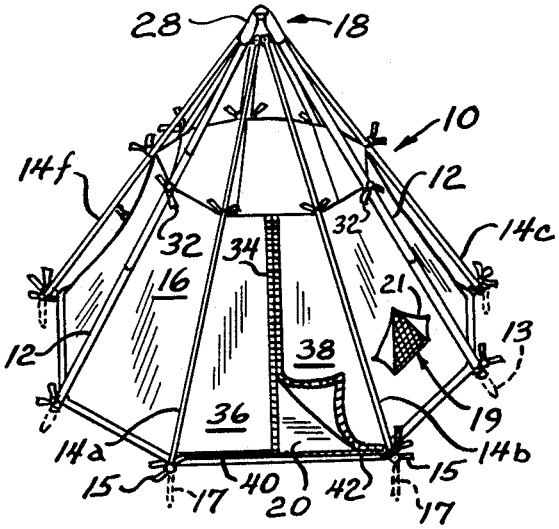
FIG. 2
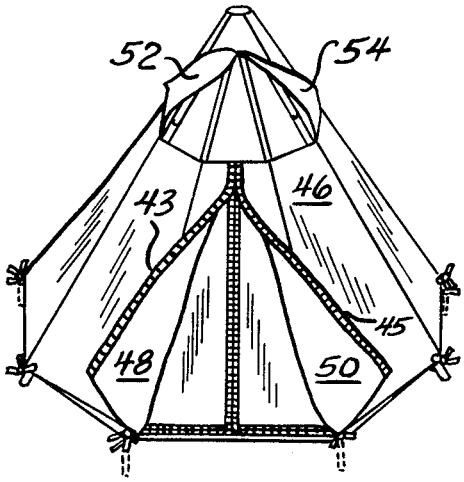
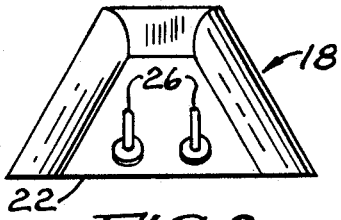
FIG. 3
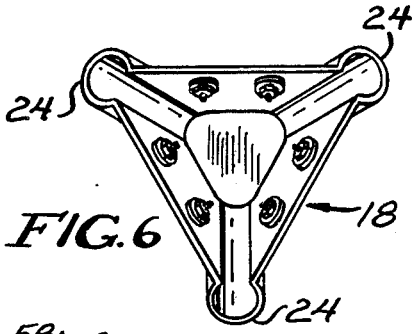
FIG. 6
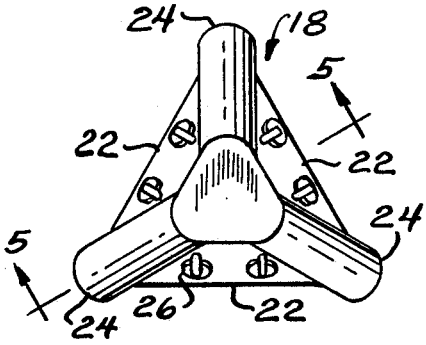
FIG. 4
FIG. 7
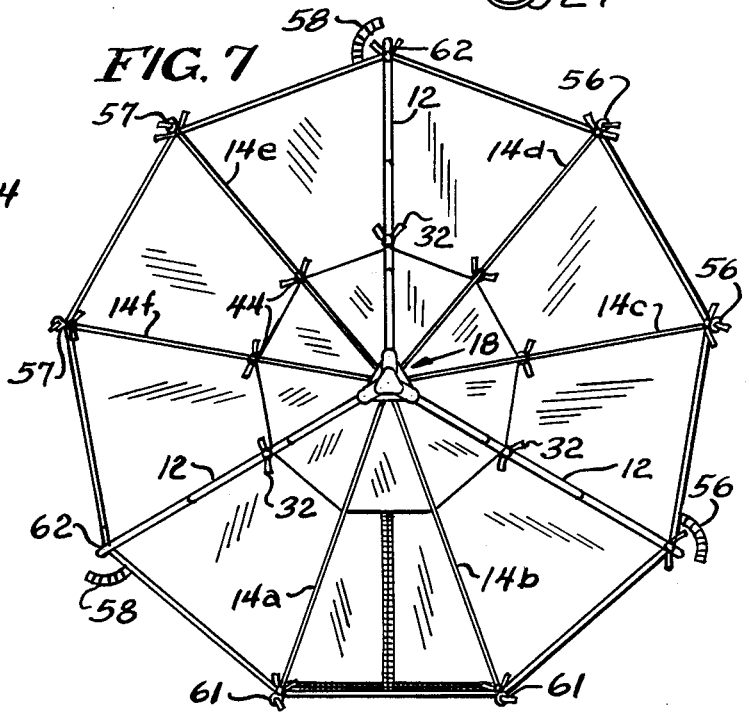
FIG. 5
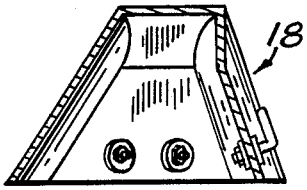

FIG. 8
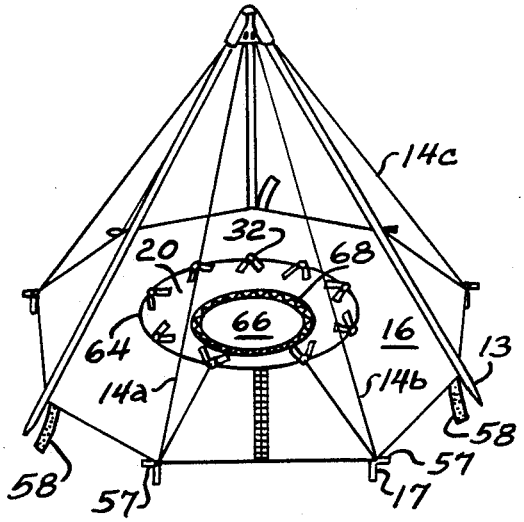
FIG. 9
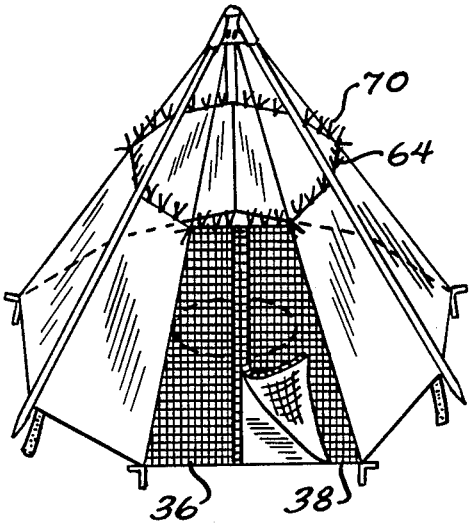
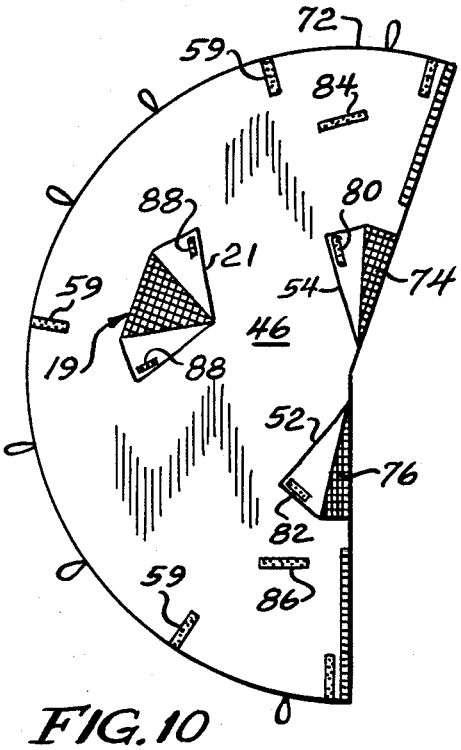
FIG. 10
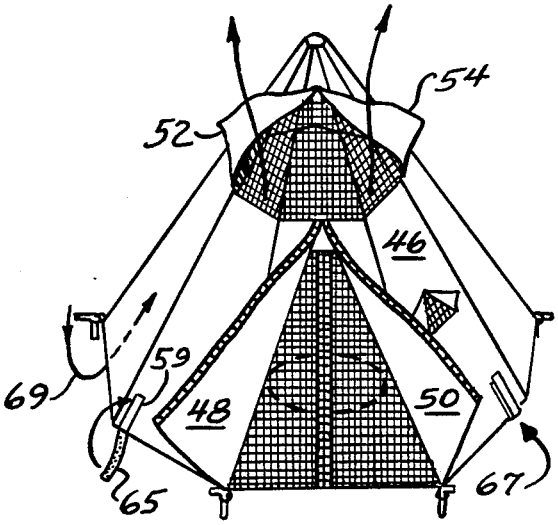
FIG. 11

TEPEE TENT

BACKGROUND OF THE INVENTION

1. Field of the Invention

This invention is in the field of portable collapsible shelters, and is more specifically directed to a flexible walled tent having an internal rigid support structure which is easily disassembled and packed into a compact package.

2. Description of the Prior Art

Several tepee tents have been previously marketed. For example, U.S. Pat. No. 2,842,145 describes a tepee tent which uses a large number of tent poles, which detracts from its portability and collapsibility. Another type of a tepee tent is described in U.S. Pat. No. 2,879,780, which uses collapsible tent poles. However, the number of poles is excessive and contributes to a weight not readily appreciated by a camper. Another type of a tepee tent is described in U.S. Pat. No. 4,011,880, which also uses a large number of poles which are collapsible but still contribute to excessive weight in its dismantled condition.

Another tent structure is described in U.S. Pat. No. 4,265,261, which uses a reduced number of tent poles which are subjected to spring members to provide a taut appearance to the tent cover. The use of springs to provide a taut appearance has the disadvantage of being lost or broken.

SUMMARY OF THE INVENTION

To avoid the disadvantages of the prior art tepee tents, the invention provides a structure using an absolute minimum of tent poles and supplants the eliminated tent poles by shock cords which not only function as replaced tent poles, but also provide a taut appearance to the erected structure. A truncated inner cover is integrally associated with a floor panel. The truncation provides an upper opening for ventilation purposes. The inner cover is primarily supported by three tent poles and further supported in each section between two adjacent tent poles by a pair of spaced shock cords. The distal ends of the tent poles penetrate the ground, and the distal ends of the shock cords are secured to stakes or tent pegs driven into the ground and which initially define the polygonal shape or formation of the tepee tent. The upper ends of the tent poles and the shock cords meet together in a common junction defined by an apex cup. The upper perimeter of the inner cover is slidably and adjustably secured to the tent stakes and the shock cords in the interior of the tent formation. An outer cover or fly is placed over the tent poles and the shock cords including the tent cover on the exterior of the tent formation, thereby providing a separation between the inner cover and the outer cover to improve ventilation. The upper portion of the outer cover is provided with flaps for providing an opening to the interior of the tepee tent for ventilation purposes.

A primary object of the invention is to provide a tepee tent using an utmost minimum of tent stakes in conjunction with a number of non-rigid stakes defined by resilient members.

Another object of the invention is to provide a suspension for an inner cover which can be tensioned to provide a taut appearance to the tepee tent.

A further object of the invention is to provide means for supporting an inner cover and an outer cover so as to provide a space therebetween for improving the flow of air between the two covers to improve thermal comfort inside the tepee tent.

Further advantages and objects of the invention will be defined more precisely in the appended specification in reference to the accompanying drawings.

BRIEF DESCRIPTION OF THE DRAWINGS

FIG. 1 shows a partial erection of a tepee tent;

FIG. 2 shows a completed erection of the tepee tent;

FIG. 3 is a side view of an apex cup which functions to commonly support all of the tent poles;

FIG. 4 is a top view of the apex cup;

FIG. 5 is a sectional illustration of the apex cup along the lines 5—5 in FIG. 4;

FIG. 6 is an underneath view of the apex cup;

FIG. 7 is a plan view of the tepee tent shown in FIG. 1;

FIG. 8 shows an inner cover of the tepee tent stretched out on ground prior to erection;

FIG. 9 shows an erected form of the inner cover provided with a screened entry;

FIG. 10 shows an outer cover of the tepee tent stretched out on ground; and

FIG. 11 shows a completed erection of the tepee tent provided with screened openings.

DESCRIPTION OF THE PREFERRED EMBODIMENT

Referring to FIG. 1, there is shown a tepee tent 10, partly erected, comprising three rigid tent poles 12 of the telescopic type and six non-rigid tent poles 14*a*–14*f*, which are more clearly illustrated in FIGS. 7 and 8. A truncated inner cover 16 is supported by the rigid and non-rigid tent poles which converge to a common point and are secured to an apex cup 18. The rigid tent poles have lower ends provided with conical points 13 for penetrating the ground. The inner cover 16 is provided with a floor panel 20 to exclude intrusion of insects. The inner cover 16 and the floor panel 20 are secured by fasteners 15 to pegs 17 driven into the ground. The inner cover 16 is provided with one or more screened openings 19 provided with closure flaps 21.

The apex cup 18 is provided with three truncated panels 22 interconnected by cylindrical sockets 24 which receive the upper ends of the rigid tent poles 12. Each truncated panel 22 is provided with a pair of spaced hooks 26 which function to receive rings 28 attached to the ends of the non-rigid tent poles 14. Instead of rings, the non-rigid tent poles 14 may possess looped ends. For example, adjacent non-rigid tent poles, such as 14*a* and 14*b*, would be connected to the same truncated panel. To provide rigidity to the apex cup 18, the upper ends of the sockets 24 are commonly joined together by a plate 30. Alternatively, the apex cup 18 may be an integrally molded unit. The inner cover 16 is provided with three fasteners 32 which are adapted to be attached to the three rigid tent poles 12 and slidably adjusted thereon. Further, the inner cover is provided with a zipper 34 for closing together flaps 36 and 38, and zippers 40 and 42 for securing the bottom edges of the flaps to the floor panel 20, the foregoing providing ingress and egress from the interior of the tepee tent.

The upper portion of the tent cover 16 is secured to each and every one of the non-rigid tent poles 14*a*–14*f* by fasteners 44. The fastener 44 permits adjustability with a certain amount of friction existing between the fastener and the non-rigid tent pole 14. The flaps 36 and 38 may be made from a screen cloth to provide visibility and ventilation.

The tepee tent 10 is completed with a fly or outer cover 46 which is draped over the tent poles as well as the inner cover. The outer cover 46 has a pair of flaps 48 and 50 in overlapping relationship to the inner cover flaps 36 and 38 and provided with further zippers 43, 45 to complete the closure of the tepee tent. The fly 46 is also provided with ventilation flaps 52 and 54 which can be secured together to completely enclose the tepee tent.

The floor panel 20, as best viewed in FIG. 7, possesses a polygonal shape, namely a nine-sided shape, which properly establishes the positioning of pegs 56. After the floor panel 20 is laid out at the camp site, the pegs 56 are driven into the ground to secure the lower ends of both the rigid and non-rigid tent poles to the ground. Thereafter, the telescopic tent poles 12 are extended and raised upwardly and inserted into the sockets 24 in the apex cup 18. Then, the shock cords 14 are attached by their looped ends 28 to the hooks 26 on the apex cup 18.

As shown in FIG. 7, the inner cover 16 is provided with three fasteners 58 for attaching the inner cover to the rigid tent poles 12. The fasteners may be of the pressure type, such as a Velcro (Trademark) strap, to pass over and around the tent pole 12. The inner cover 16 is provided with loops 57 for securing the inner cover to the pegs 17, which also function to engage the looped ends 61 of the non-rigid tent poles 14*a*–14*f*. Understandably, the conical points 13 on the rigid tent poles 12 penetrate appropriate looped ends 62 of the inner cover 16.

A modification of the tepee tent shown in FIG. 1 is illustrated in FIGS. 8–11.

As shown in FIG. 8, the inner cover 16 is stretched out on the ground having an upper perimeter 64 provided with fasteners 32. It should be mentioned here that identical components shown in FIGS. 1 and 8 will be identified by identical reference numerals. Pegs 17 are driven through the looped ends 57 at each corner of the inner cover 16 into the ground. Three corners of the inner cover 16 are secured to the tent poles 12 by fasteners 58. The floor panel 20 is provided with a central opening closed by a fire hole cover 66, which is attachable to the floor panel 20 by a circular pressure-engaging means 68, such as a Velcro (Trademark) closure. To erect the inner wall 16, the perimeter 64 is raised upwardly and attached to the rigid and non-rigid tent poles by the fasteners 32.

As shown in FIG. 9, the inner cover 16 has a perimeter 64 also provided with a furred edge 70 which is adapted to abut the undersurface of the fly 46 which is separated from the inner cover 16 by the rigid and non-rigid tent poles. The object of the furred edge is to provide air flow between the inner cover and the fly and simultaneously prevent the entry of any insects into the interior of the tepee tent. The flaps 36 and 38 are made from screen cloth.

Referring to FIG. 10, there is shown a fly 46 laid out on the ground, having a perimeter 72 provided with loops 63 for attachment to the pegs 17 and having fastener strips 59 which are adapted to engage fastener straps 65 extending from an inner surface of the inner cover 16, as shown in FIG. 11. The clasped fastener 59 and strap 65 is shown at 67. The foregoing arrangement secures together the inner cover 16 and the fly 46. The fly 46 has certain portions 74, 76, and 78 made from screen cloth to provide ventilation and exposure to daylight. The opening associated with the flaps 52 and 54 in FIG. 11 will also permit the escape of smoke if a fire is built within the tepee tent.

Flaps 52 and 54 are provided with pressure-engaging fasteners 80 and 82 to secure the flaps in a closed position to prevent the entry of rain or cold air. The flaps 52 and 54 are retained in their open position, as shown in FIG. 10, by another pair of pressure-engaging fasteners which cannot be seen under the flaps. The flaps 48 and 50 shown in open condition in FIG. 11 are retained in that position by means of pressure-engaging fasteners 84 and 86. Similarly, the screened opening 19 in FIG. 10 is associated with flaps 21 which are retained in their open position by pressure-engaging fasteners 88 in engagement with similar fasteners underneath the flaps (not shown).

The air flow between the inner cover and the fly 46 is shown by an arrow 69.

What is claimed is:

1. A tepee tent comprising three rigid telescopic tent poles, at least three non-rigid and resilient tent poles, all of said tent poles having lower ends, spaced from each other and extending upwardly and converging toward a common point, an apex cup securing upper ends of said tent poles at said common point, said tent poles and apex cup defining a skeletal structure, a polygonal floor panel integrally formed with a tent cover positioned within said structure and conically tapering toward said common point, fasteners for attaching said floor panel and said tent cover at polygonal corners to said tent poles, and means for attaching the upper portion of said tent cover to said tent poles, whereby said tent cover is supported on the interior of said structure.

2. A tepee tent according to claim 1, wherein said non-rigid resilient tent poles comprise shock cords.

3. A tepee tent according to claim 1, wherein said apex cup is provided with three sockets for admitting ends of said rigid tent poles and hooks for securing looped ends of said non-rigid tent poles.

4. A tepee tent according to claim 1, including a fly draped over said structure and having a polygonal base and conically tapering toward said common point, first fasteners for attaching said fly at polygonal corners to said tent poles and second fasteners for securing said fly and tent cover together at said floor panel.

5. A tepee tent according to claim 4, including pegs for commonly attaching said fly and said tent cover to a ground surface.

6. A tepee tent according to claim 1, wherein one side of said polygonal tent cover is formed by a pair of closable flaps to provide ingress and egress into the interior of the structure.

7. A tepee tent according to claim 6, wherein one side of said polygonal fly is formed by a pair of closable flaps which overlap corresponding flaps on said tent cover.

8. A tepee tent according to claim 2, wherein lower ends of said shock cords are formed with loops attachable to pegs and the upper ends terminate in loops for attachment to hooks on said apex cup.

9. A tepee tent comprising a plurality of rigid and non-rigid tent poles having lower ends spaced from each other and defining a polygon base and upper ends converging toward a common point, an apex cup securing said upper ends at said common point, said tent poles defining a skeletal structure, a complementary polygonal floor panel integrally formed with a truncated polygonal sided inner cover extending upwardly to define a polygonal opening having a perimeter, said floor panel and said inner cover being disposed inside said structure, a plurality of fasteners spaced along said perimeter for securing said inner cover to said tent poles, a pair of closable flaps defining one wall of said inner cover to provide an entrance, a complementarily-shaped polygonal fly draped over said tent poles and extending from the top of said apex cup to said floor panel, a pair of closable flaps defining one wall of said fly and registering with the flaps in the inner cover to define an entrance, and means for securing said inner cover and fly together.

10. A tepee tent according to claim 9, wherein said non-rigid resilient tent poles comprise shock cords.

11. A tepee tent according to claim 9, wherein said apex cup is provided with three sockets for admitting ends of said rigid tent poles and hooks for securing looped ends of said non-rigid tent poles

12. A tepee tent according to claim 9, including pegs for commonly securing said fly and inner cover to a supporting surface.

13. A tepee tent according to claim 9, wherein said perimeter is provided with fur interposed between said fly and said inner cover.

14. A tepee tent according to claim 9, wherein the flaps in the inner cover are made from screen cloth.

15. A tepee tent according to claim 9, wherein said fly, adjacent said apex cup, is provided with a screened opening, and a flap means for covering said screened opening.

16. A tepee tent according to claim 12, including loops extending from corners of said inner cover and extending from corners of said fly for engagement with said pegs.

17. A tepee tent according to claim 9, said floor panel having a central opening exposing the interior of the structure to a ground surface to permit a fire to be built inside, and a cover closing said opening if no fire is intended, and pressure-engaging members on the perimeters of said cover and said opening for detachably sealing said opening.

18. A tepee tent according to claim 9, including pressure-engaging members disposed along lower perimeters of said inner cover and fly for joining together said inner cover and fly.

* * * * *